US012302974B2

(12) United States Patent
Schuster

(10) Patent No.: US 12,302,974 B2
(45) Date of Patent: May 20, 2025

(54) BUMPER COVER FOR SPORTS HELMET

(71) Applicant: SLEEFS LLC, Davie, FL (US)

(72) Inventor: Jaime Schuster, Davie, FL (US)

(73) Assignee: Sleefs, LLC, Davie, FL (US)

( * ) Notice: Subject to any disclaimer, the term of this patent is extended or adjusted under 35 U.S.C. 154(b) by 13 days.

(21) Appl. No.: 18/225,121

(22) Filed: Jul. 22, 2023

(65) Prior Publication Data

US 2025/0024905 A1 Jan. 23, 2025

(51) Int. Cl.
*A42B 3/04* (2006.01)

(52) U.S. Cl.
CPC ..... *A42B 3/0406* (2013.01)

(58) Field of Classification Search
None
See application file for complete search history.

(56) References Cited

U.S. PATENT DOCUMENTS 2,634,415 A * 4/1953 Turner ..... A42B 3/12 D29/106
3,263,236 A * 8/1966 Humphrey ..... A42B 3/20 2/9
3,467,964 A * 9/1969 Hannan ..... A42B 3/10 2/410
4,326,303 A * 4/1982 Rappleyea ..... A42B 3/08 2/425
5,519,892 A * 5/1996 Pizzacar ..... A42B 1/248 40/329
5,632,047 A * 5/1997 Van Den Heuvel ... A42B 1/248 2/171.4
5,740,557 A * 4/1998 Reid ..... A42B 1/248 2/244
5,978,973 A * 11/1999 Chartrand ..... A42B 3/20 2/424
6,006,362 A * 12/1999 Walsh ..... A42B 1/248 2/181.2
6,240,568 B1 * 6/2001 Lee ..... A41D 27/08 40/329
6,272,692 B1 * 8/2001 Abraham ..... A42B 3/063 2/909
6,490,737 B1 * 12/2002 Mazzei ..... A61G 13/12 2/9
8,191,178 B2 * 6/2012 Mangel, Jr. ..... A42B 3/0406 2/9
8,388,164 B2 * 3/2013 Waters ..... G02C 11/04 362/255
8,496,009 B2 * 7/2013 Manzo ..... A63B 71/085 128/862

(Continued)

FOREIGN PATENT DOCUMENTS

WO WO-2020247554 A1 * 12/2020 ..... A42B 1/242

OTHER PUBLICATIONS

"Bumpers—Front & Back." School Pride. May 7, 2020. https://schoolpride.com/decals/football-decals/bumpers (Year: 2020).*

*Primary Examiner* — Grace Huang
(74) *Attorney, Agent, or Firm* — My Patent Guys; Christopher Pilling

(57) ABSTRACT

The present invention relates to bumper covers designed to act as a logo for sports helmets. The bumper cover is a protective accessory that serves the dual purpose of safeguarding the helmet and displaying team logos or other identifying marks.

3 Claims, 13 Drawing Sheets

(56) References Cited

U.S. PATENT DOCUMENTS

| | | | | |
|---|---|---|---|---|
| 8,544,117 | B2 * | 10/2013 | Erb | A42B 3/122 2/412 |
| 8,621,671 | B1 * | 1/2014 | Schiebl | A42B 3/205 2/421 |
| 8,959,668 | B1 * | 2/2015 | Ganes | A42B 3/205 2/9 |
| 9,609,902 | B2 * | 4/2017 | Waters | A42B 1/244 |
| 10,492,555 | B2 * | 12/2019 | Lebel | A42B 3/042 |
| 10,595,579 | B2 * | 3/2020 | Albani | A42B 3/283 |
| 10,743,600 | B2 * | 8/2020 | Cleveland | A42B 3/064 |
| 11,026,466 | B2 * | 6/2021 | Vanhoutin | A42B 3/122 |
| 11,540,585 | B2 * | 1/2023 | Cleveland | A42B 3/16 |
| 11,759,364 | B2 * | 9/2023 | Huh | A61F 9/06 2/8.3 |
| 11,910,859 | B2 * | 2/2024 | Bologna | A42B 3/08 |
| 2007/0163158 | A1 * | 7/2007 | Bentz | G09F 15/00 40/329 |
| 2008/0066215 | A1 * | 3/2008 | Thompson | A42B 1/0182 2/175.5 |
| 2008/0109940 | A1 * | 5/2008 | Van Den Heuvel | A42B 1/248 2/244 |
| 2012/0317705 | A1 * | 12/2012 | Lindsay | A42B 3/062 2/413 |
| 2018/0163915 | A1 * | 6/2018 | Halper | F16M 11/041 |
| 2019/0216155 | A1 * | 7/2019 | Zents | A42B 3/085 |
| 2020/0060374 | A1 * | 2/2020 | Glover | A42B 3/127 |
| 2020/0345097 | A1 * | 11/2020 | Castiglione | A42B 3/14 |
| 2022/0061448 | A1 * | 3/2022 | Withnall | A42B 3/20 |

* cited by examiner

BUMPER COVER FOR SPORTS HELMET

FIELD OF THE INVENTION

The invention generally relates to a protective sports helmet, such as a football, lacrosse, hockey or baseball helmet, worn by a player during the play of a contact sport. The inventive helmet includes bumper covers for protecting the front and rear bumpers and acting as logos which can be removed and replaced when needed.

BACKGROUND OF THE INVENTION

American football helmets are crucial for protecting players' heads from potential injuries during gameplay. However, helmets often lack the ability to display team logos or other branding elements. While some helmets may have decals imprinted on the shell, these are prone to wear or damage requiring regular replacement.

However, due to more collision and contact with the ground the logos/decals tends to wear out from the front and rear bumpers. For installing a new decal/logo, stickers with adhesives are used which are difficult to use and take substantial time for installations. Removal of these adhesive stickers is also challenging and time consuming.

U.S. Pat. No. 8,191,178 discloses a mouth guard holder for sports helmet. The mouth guard holder comprises a pair of mounts each mount having a generally concave back surface and a flat front surface and configured to be fixed to an exterior surface of a helmet. The mouth guard holder comprises a front face plate. The helmet brand or logo directly on the face plate outwardly displayed.

Therefore, there is a need for an innovative solution that not only offers added protection to the helmet but also allows for a secure and long-lasting display of team logos or other branding elements.

SUMMARY

The present invention introduces bumper covers designed to act as logo for sports helmets. The bumper covers are removable and customizable accessory that provides additional protection to the helmet while acting as a platform for displaying team logos or other identifying marks. The bumper covers are manufactured using a combination of materials that ensure durability, impact resistance, and easy customization options.

In a further aspect, the sports helmet comprises a front bumper cover for covering the front bumper. The front bumper cover comprises attachment means for securing the bumper cover fixedly on the front bumper. The attachment means may comprise projections tabs for locking on the back surface of the front bumper. The front bumper cover is slidably attached to the front bumper of the helmet.

In a further aspect, the sports helmet comprises a rear bumper cover for covering the rear bumper. The front bumper cover comprises attachment means for securing the bumper cover fixedly on the front bumper. The attachment means may comprise projections tabs for locking on the back surface of the rear bumper.

It is a further object of the present invention to provide such a helmet with enhanced bumper covers to acting as replaceable logos and decals for the teams.

These and other objects, aspects and features of the present invention will be better understood from the following detailed description of the preferred embodiments when read in conjunction with the appended drawing figures.

The bumper cover includes a logo display area that is easily customized with team logos or other identifying marks. The logo display area is removable insert that can be easily replaced with a new logo or design. The logo display area is made of a clear, flexible material that allows the logo or design to be clearly visible while protecting it from damage.

The bumper cover can be used with a variety of sports helmets, including football helmets, hockey helmets, lacrosse helmets, and other protective headgear. The bumper cover is available in a variety of colors and designs to match team colors and logos. In some embodiments, the bumper covers are manufactured from 3D printing or molding methods.

DETAILED DESCRIPTION OF THE INVENTION

The following detailed description set forth below in connection with the appended drawings is intended as a description of exemplary embodiments in which the presently disclosed subject matter may be practiced. The term "exemplary" used throughout this description means "serving as an example, instance, or illustration," and should not necessarily be construed as preferred or advantageous over other embodiments. The detailed description includes specific details for providing a thorough understanding of the presently disclosed bumper cover for sports helmet. However, it will be apparent to those skilled in the art that the presently disclosed subject matter may be practiced without these specific details. In some instances, well-known structures and devices are shown in functional or conceptual diagram form to avoid obscuring the concepts of the presently disclosed arm wearable illuminating device.

In the present specification, an embodiment showing a singular component should not be considered limiting. Rather, the subject matter preferably encompasses other embodiments including a plurality of the same component, and vice-versa, unless explicitly stated otherwise herein. Moreover, the applicant does not intend for any term in the specification to be ascribed an uncommon or special meaning unless explicitly set forth as such. Further, the present subject matter encompasses present and future known equivalents to the known components referred to herein by way of illustration.

Unless explicitly stated otherwise, throughout the description and the claims, the words "comprise(s)," "comprising," "include(s)," "including," and the like, are to be construed in an inclusive sense as opposed to an exclusive or exhaustive sense; that is to say, in the sense of "including, but not limited to."

In the following detailed description of the embodiments of the disclosure, reference is made to the accompanying drawings that form a part hereof, and in which are shown by way of illustration of specific embodiments in which the disclosure may be practiced. These embodiments are described in sufficient detail to enable those skilled in the art to practice the disclosure, and it is to be understood that other embodiments may be utilized and that changes may be made without departing from the scope of the present disclosure. The following description is, therefore, not to be taken in a limiting sense. In the following description, well known functions or constructions are not described in detail since they would obscure the description with unnecessary detail.

Figure 1:
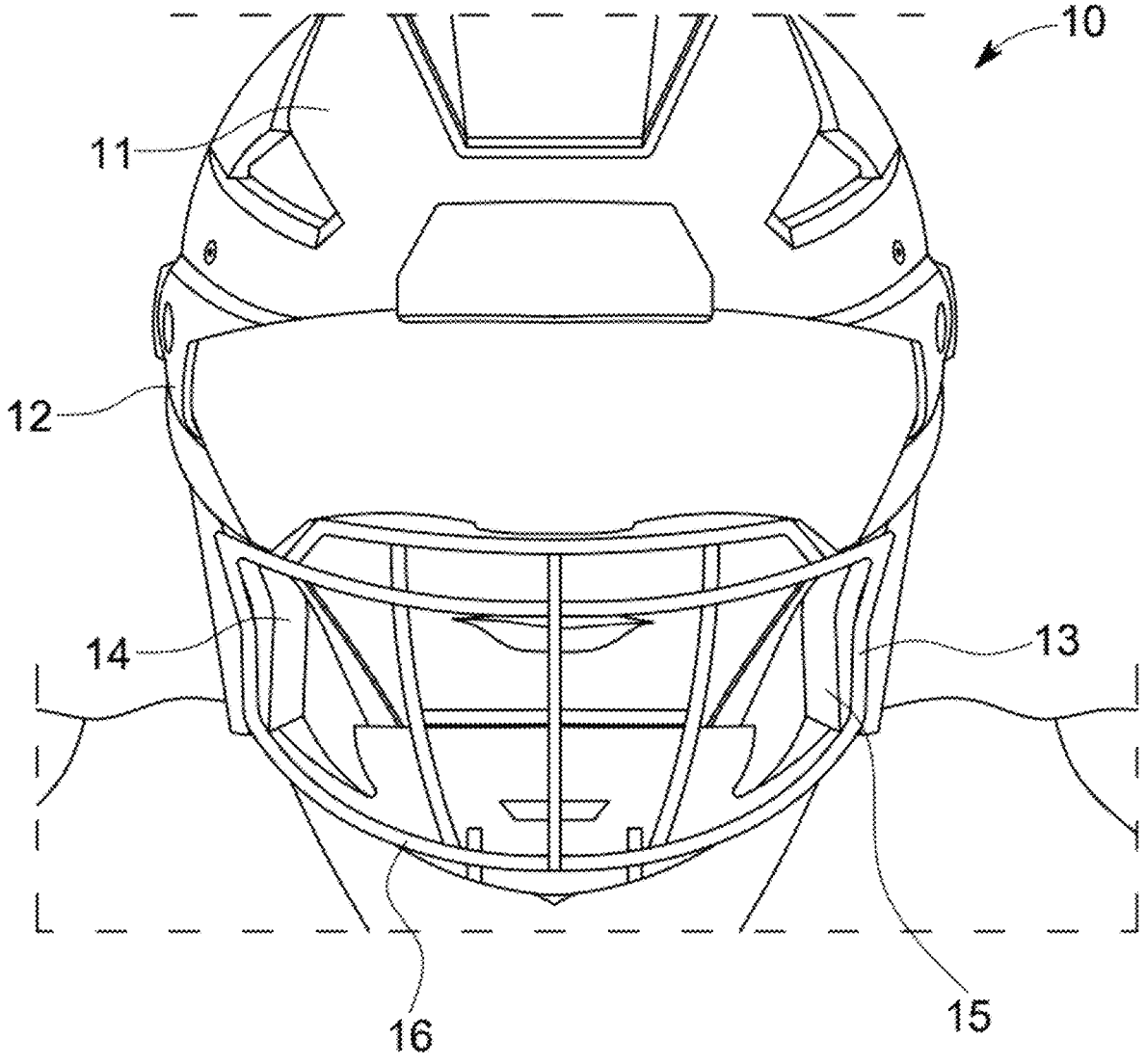
FIG. 1-2 shows a perspective view of a preferred embodiment of the helmet in accordance with the teachings of the present invention.
Figure 9:
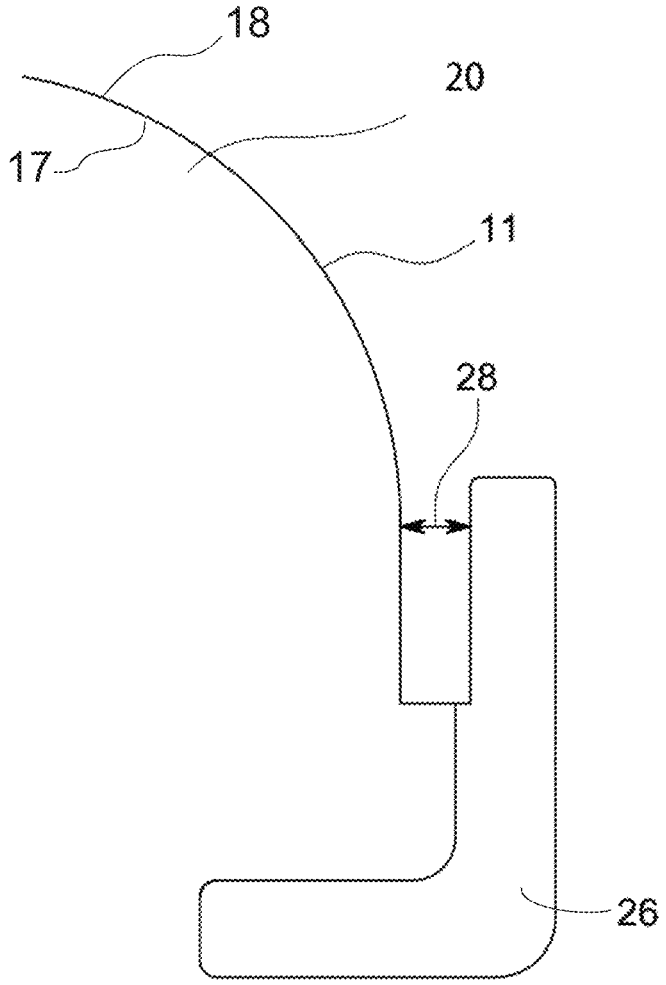
FIG. 9 shows the cross section of the rear portion of the sports helmet.

Referring to FIG. 1, a sports helmet 10 in accordance with the present invention is shown to generally include: an outer shell 11 with an ear region 12 and a jaw region 13, a faceguard 14 that spans a frontal shell opening, and an internal padding assembly 15. The outer shell 11 is preferably made of a suitable plastic material having the requisite strength and durability characteristics to function as a football helmet, or other type of protective helmet, such as polycarbonate plastic materials. Alternatively, the shell is made from a fiber reinforced plastic resin, wherein carbon fibers are utilized. Outer shell 11 has an inner wall surface 17 (FIG. 9) and an outer wall surface 18 (FIG. 9).

The faceguard 14 comprises a plurality of elongated bar members 16, which may be formed of any suitable material having the requisite strength and durability characteristics to function as a football helmet faceguard. The members 16 may be preferably formed of a metallic material, such as steel or titanium, and as is known in the art, the bar members 16 may be provided with a durable coating (e.g., plastic coating). Additionally, the bar members 16 may be of a solid or tubular cross-sectional configuration. Alternatively, bar members 16 may be formed of a suitable plastic material, including a fiber reinforced plastic resin, having the requisite strength and durability characteristics to perform the functions of a football helmet faceguard.

Figure 2:
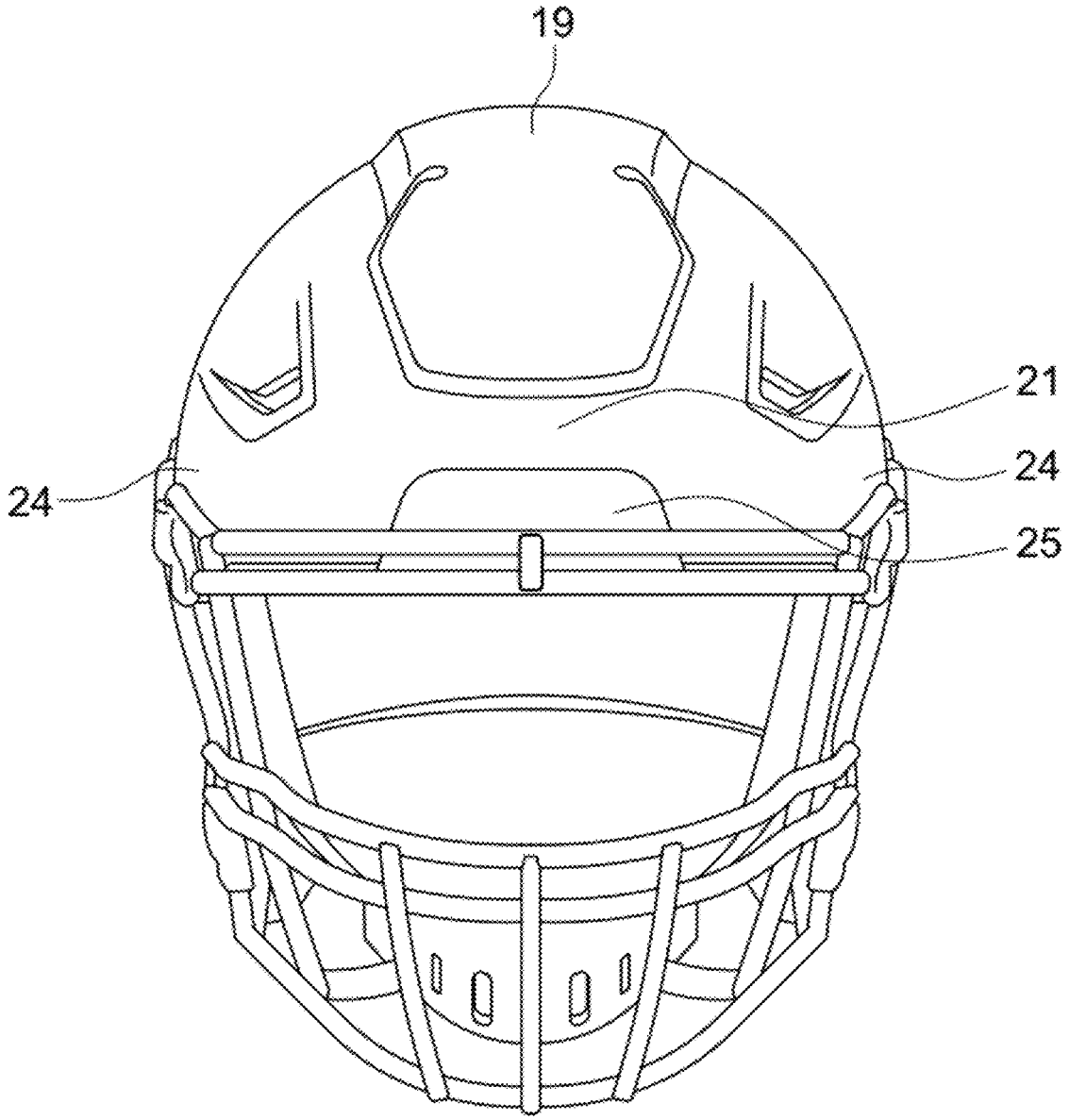
Figure 3:
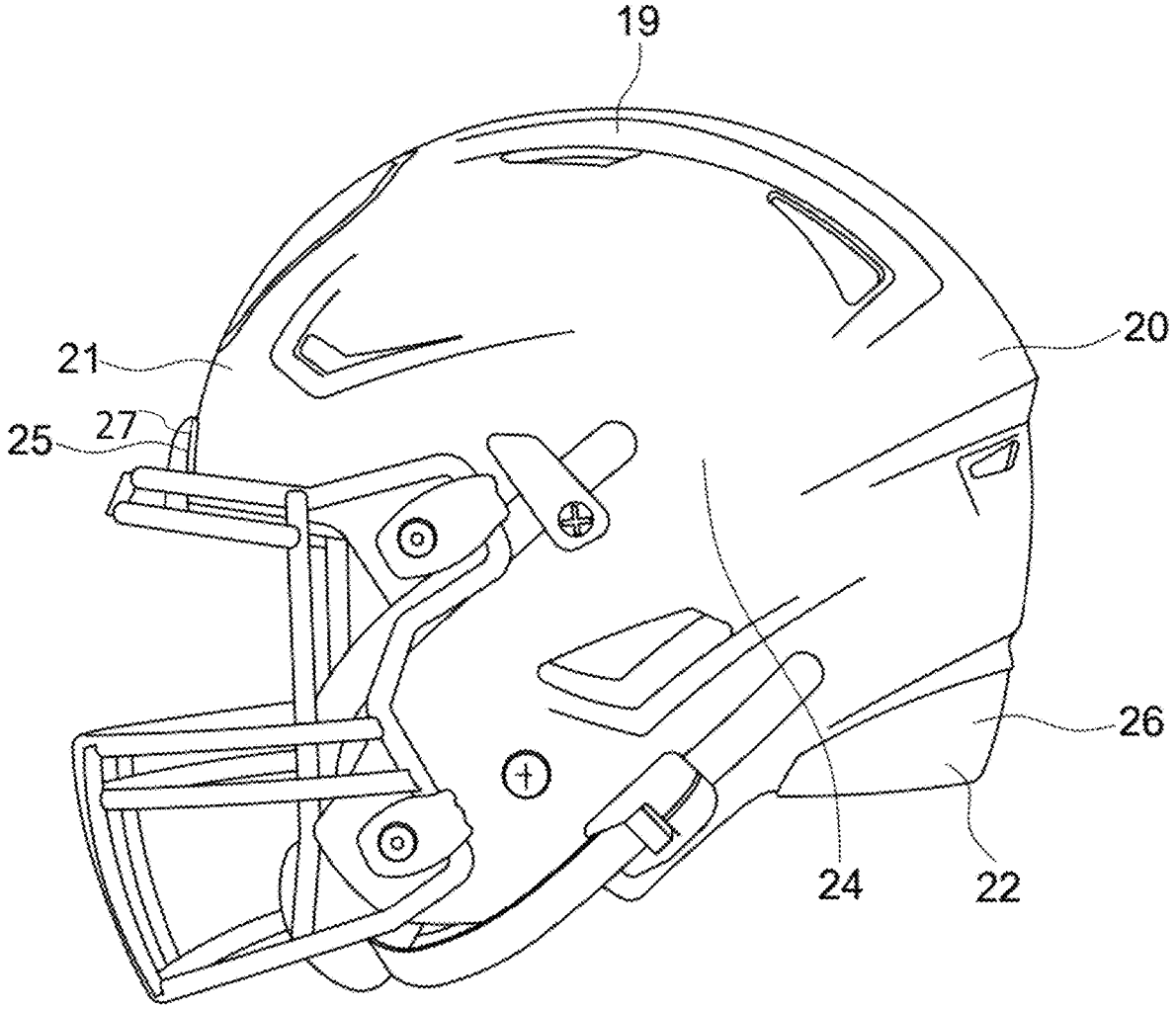
FIG. 3 shows a side view of the inventive helmet.

Referring to FIGS. 2-3, the shell 11 further includes a crown 19, a back 20, a front 21, a lower edge surface 22, and two side regions 24 (which include the ear region 12 and jaw region 13). Shell 11 is adapted to receive the head of a wearer of the helmet 10. Referring again to FIGS. 2 and 3, the front region 21 comprises a front bumper 25, and the back region 20 comprises a rear bumper 26. The front bumper 25 and rear bumper 26 are attached to shell 11 of the helmet 10 by known fastening means such as screws, adhesives etc. The bumpers 25 and 26 are fabricated from material that is able to withstand the impact on the helmet and attenuates it. A material which has a compressible nature such as foam will be better suited for such kind of application.

In another embodiment, the bumpers 25 and 26 can be multi layered structures comprising cover fabric layer and a shock absorbing foam layer. The cover fabric layer is manufactured from a material that is light, soft, and dries quickly, yet has strong durability and strength. The shock absorbing foam layer is preferably made of a material selected from latex and NBR foam having excellent cushioning and shock absorption.

As can be seen in the FIG. 3, a gap 27 is present between the lateral/boundary edges of the bumper 25 and the shell 11.

Figure 4:
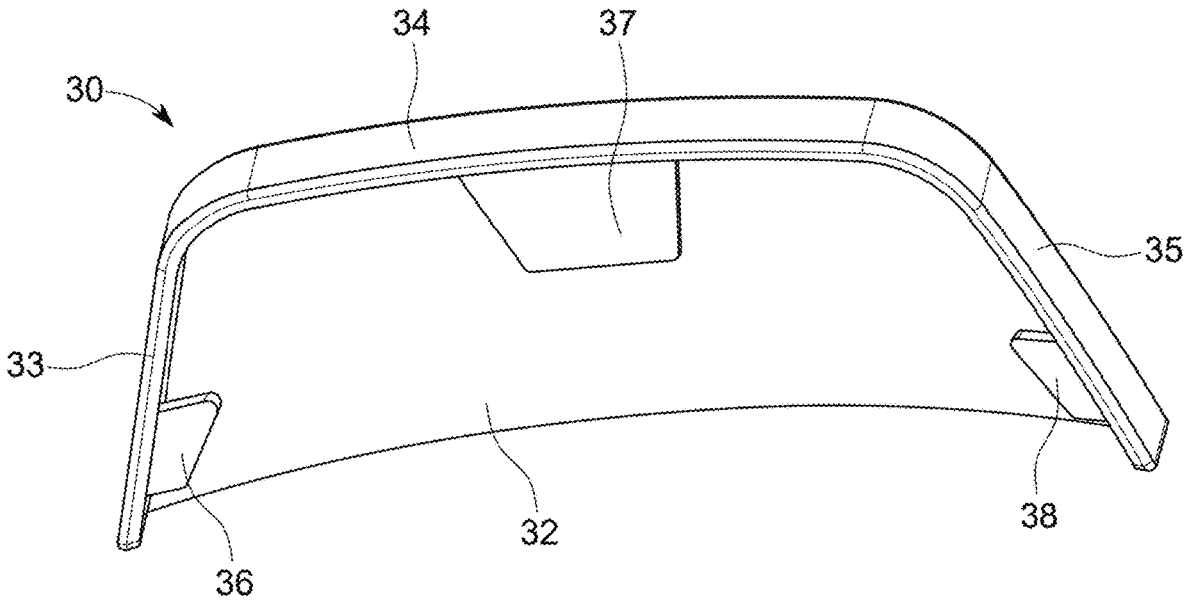
FIG. 4 shows perspective view showing the front bumper cover.
Figure 5:
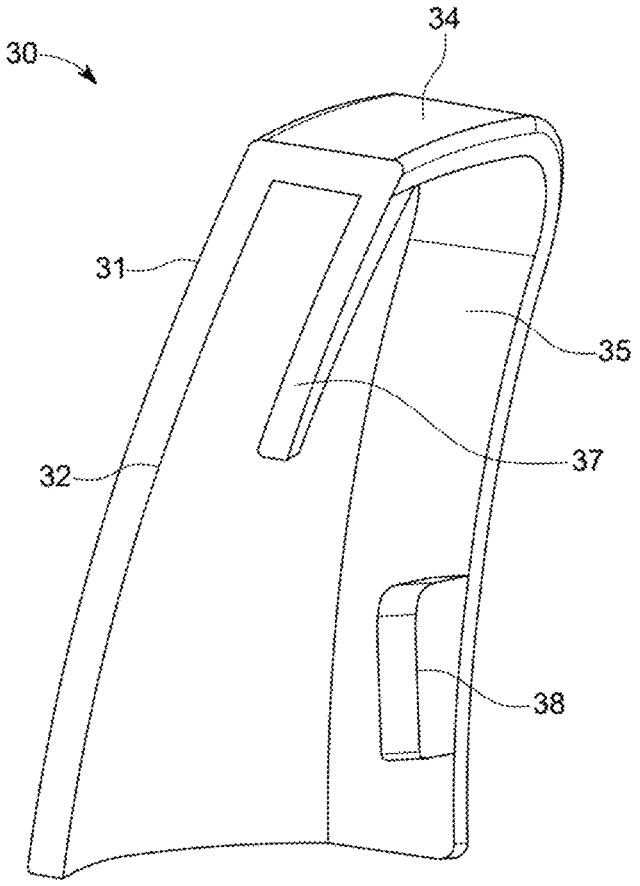
FIG. 5 shows the cross section view of the front bumper cover.

FIG. 4 shows a front bumper cover 30 for covering the bumper 25. The cross section of front bumper cover 30 is shown in FIG. 5. The front bumper cover comprises a front face 31 and a rear face 32. The rear face 32 is provided with three walls 33, 34, 35. The walls are connected to each other. In other embodiment, the walls are formed of one continuous length. The walls are provided in the plane perpendicular to the surface of the front face 31 and back face 32 extending along the direction of the back face 32. The perpendicular walls 33, 34, 35 are provided with attachment tab 36, 37, 38. The attachment tabs extends inwards along their length, such that when the front bumper cover 30 is installed over the front bumper 24, the attachment tabs holds the front bumper 24 fixedly, and cannot be removed until an external force is applied on the front bumper cover 30.

Figure 6:
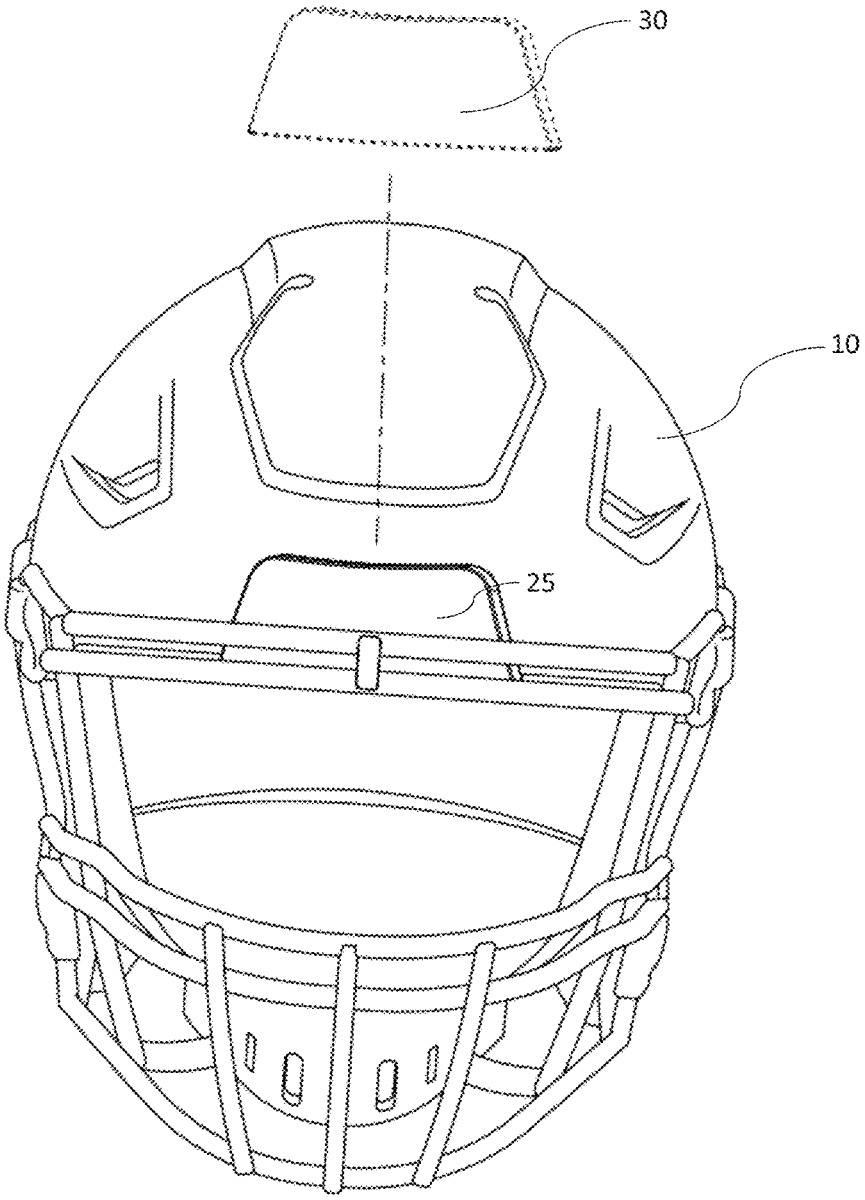
FIG. 6-8 shows the method of attaching the front bumper cover on the front bumper of the sports helmet.
Figure 7:
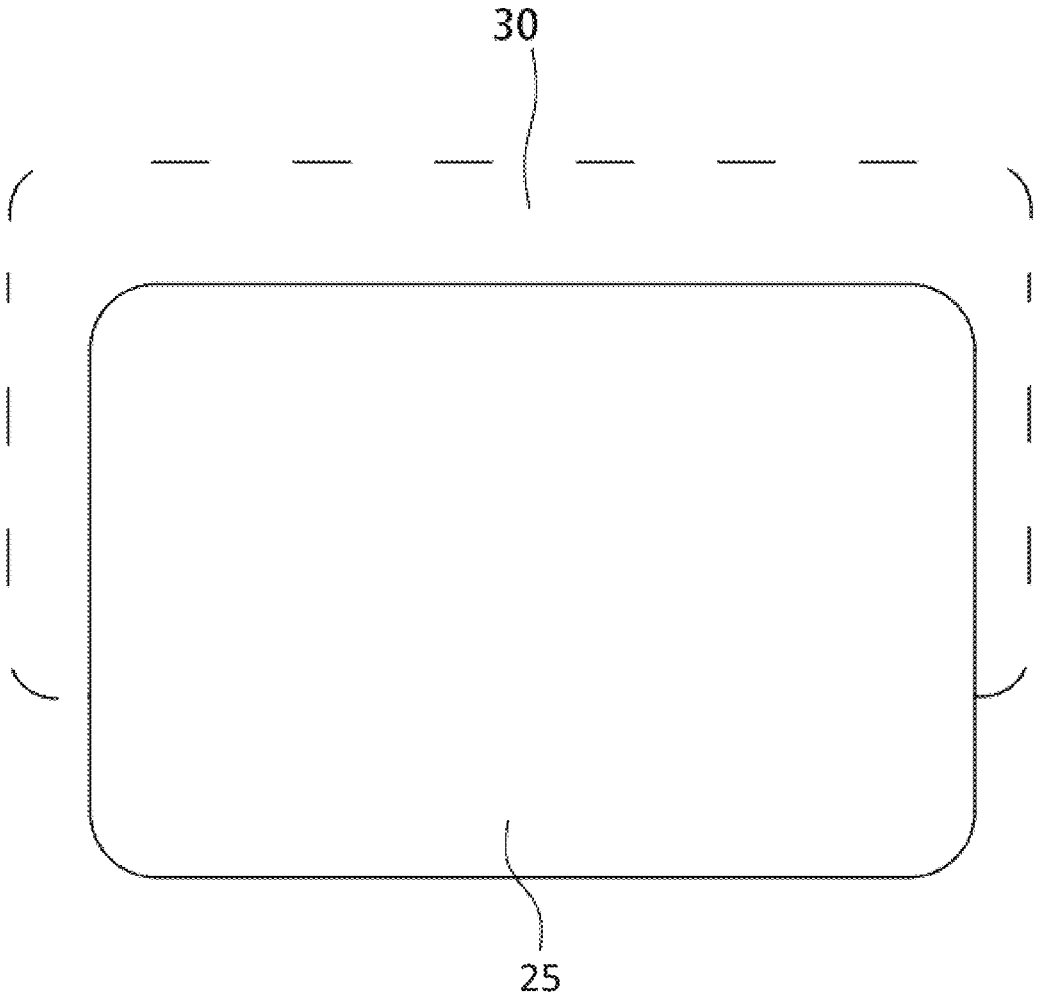
Figure 8:
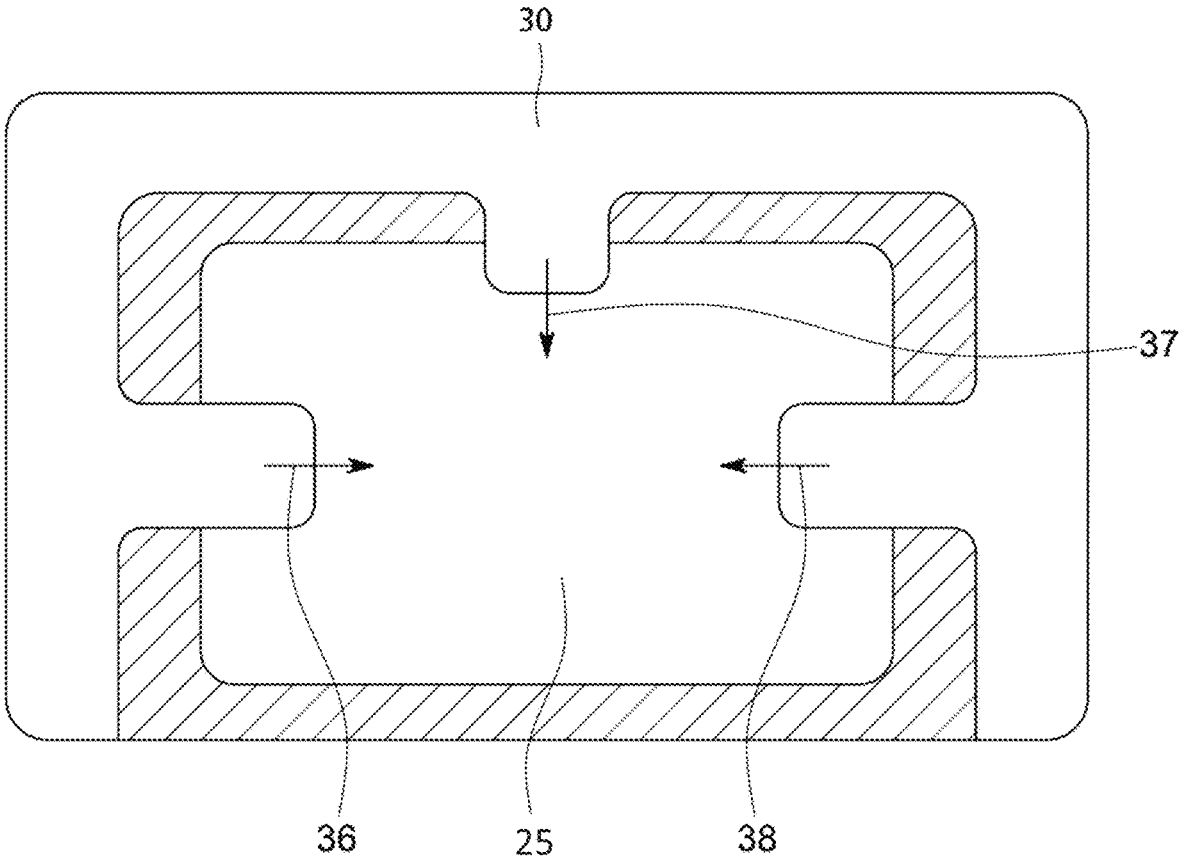

FIG. 6-8 shows the process of installation of the front bumper cover 30 on the front bumper 25. The front bumper cover 30 is placed front bumper 25. The attachment tab 36, 37, 38 are arranged in the gap 27 present between the front bumper 25 and the shell 11. The front bumper cover 30 is then slid down along the vertical length of the front bumper 25. Since, the attachment tabs are extending in the internal direction, the projection/attachment tabs fixedly engage with the surface of the front bumper, resulting in locking of the front bumper cover 30 with the front bumper 25. The holding force of the attachment tabs is such that an external force will be required to separate the front bumper cover 30 from the front bumper 25.

Referring now FIG. 9, the cross section view of the helmet along the centre line. Focusing on the rear bumper 26. A gap 28 is present between the lateral/boundary edges of the bumper 26 and the shell 11. Further, the rear bumper extends in the vertical direction from the shell 11, such that lower part of the rear bumper is below the shell 11 when viewed along the cross section line.

Figure 10:
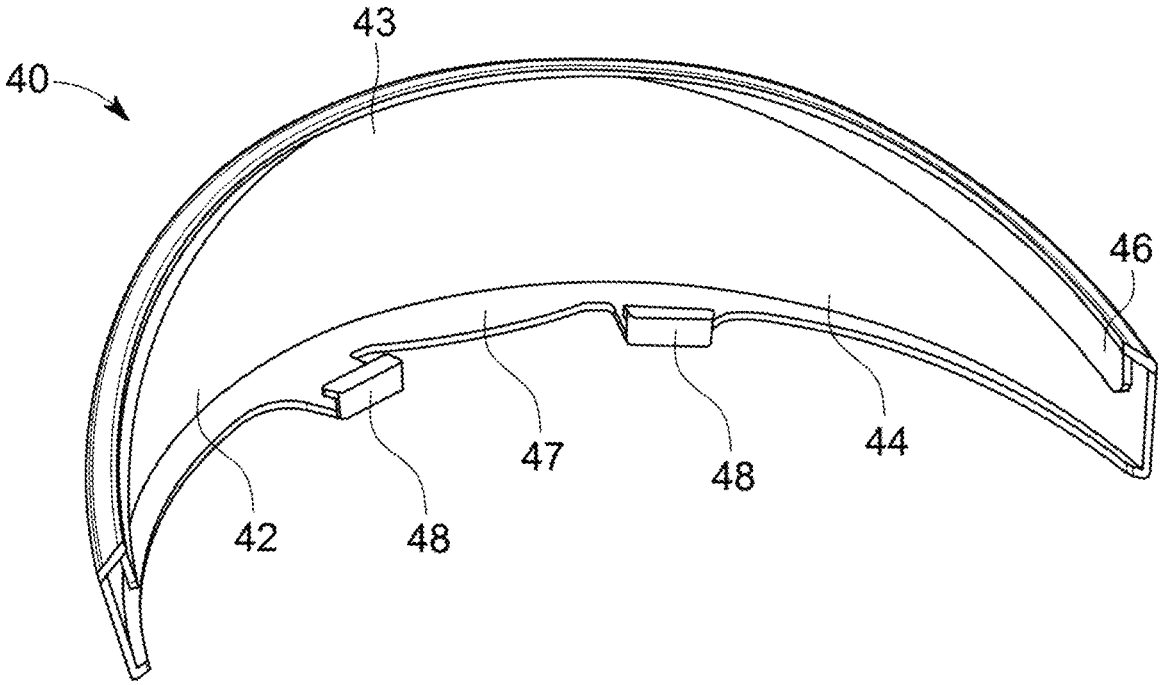
FIG. 10 shows perspective view showing the rear bumper cover.
Figure 11:
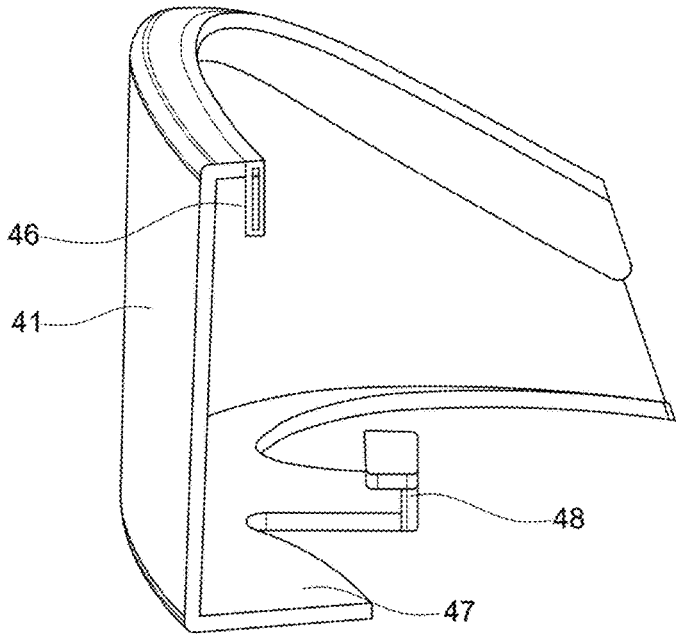
FIG. 11 shows the cross section view of the rear bumper cover.
Figure 12:
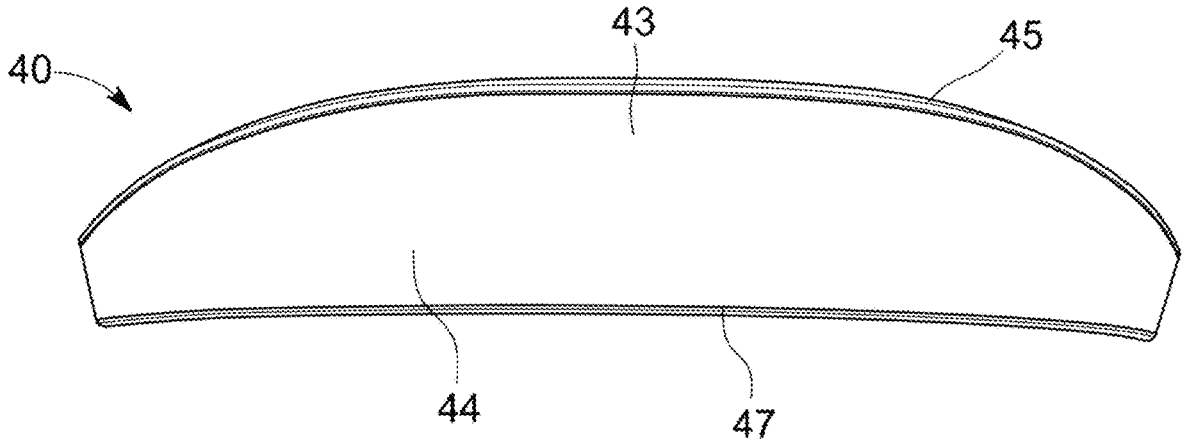
FIG. 12 shows the front view of the rear bumper cover.

Referring now to FIG. 10-12, the rear bumper cover 40 arranged on the rear bumper 26 is shown. The rear bumper cover 40 comprises a front face 41 and a rear face 42. The rear face 42 faces the external surface of the rear bumper 26. The rear bumper cover 40 further includes an upper region 43 and a lower region 44. The upper region 43 depicts a curved edge 45 when viewed along the front direction. The lower region 44 depicts as a horizontal line when viewed along the front direction. The upper region 43 comprises an inverted U shaped projection 46 which extends along the length of the curve 45. The lower region 44 comprises a surface 47 extending in a plane perpendicular to the front direction and in a direction towards the rear face 42. The surface 47 further comprises attachment projections 48.

Figure 13:
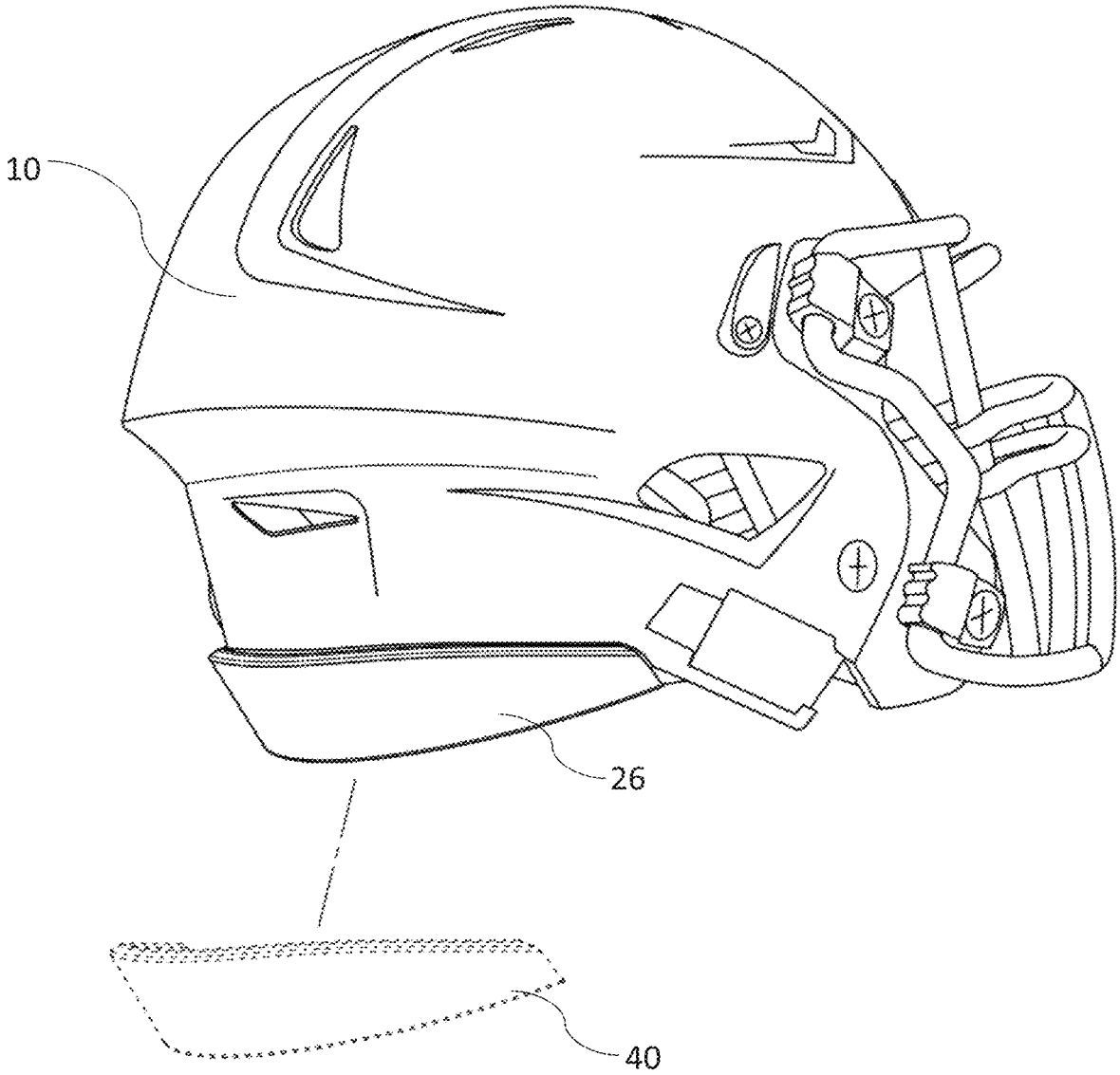
FIG. 13-14 shows the method of attaching the rear bumper cover on the rear bumper of the sports helmet.
Figure 14:
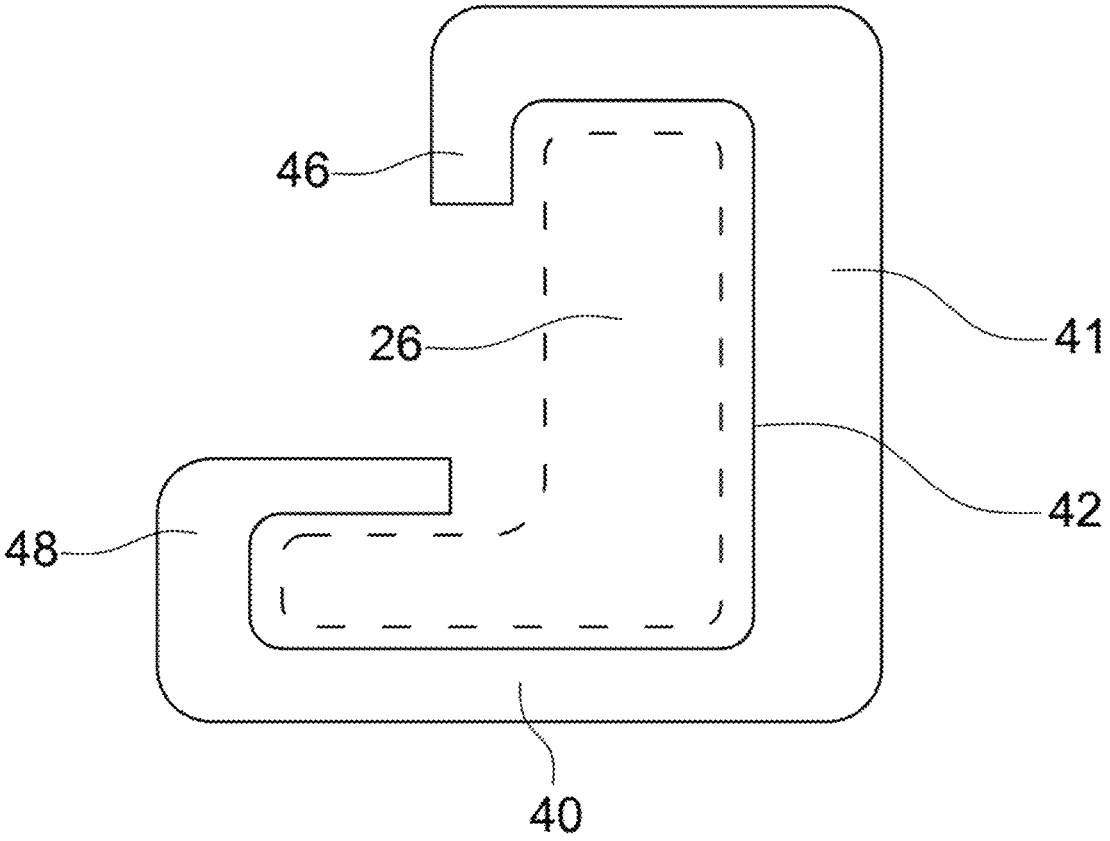

FIG. 13 will explain the locking the rear bumper cover 40 with respect to the rear bumper 26. The U shaped projection 46 of the rear bumper cover is installed between the gap 28 present between the shell 11 and rear bumper 26. The projections 48 are arranged on the lower end of the rear bumper 26 such that the rear bumper cover 40 snugly fits over the rear bumper 26. The projections 48 fixedly locks the lower end of the rear bumper 26 with the rear bumper cover 40.

The bumper covers mentioned above can further comprise other attachment components that can firmly hold the bumper covers 30, 40 in place while ensuring it remains intact during rigorous gameplay.

In another embodiment, the bumper covers are made of a durable, flexible material that can withstand impact and abrasion. The bumper cover are designed to fit snugly over the bumper and are secured in place using a hook and loop fastener or other suitable fastening mechanism.

The bumper covers are manufactured using a combination of impact-resistant materials. These materials should be flexible, yet durable, to withstand the physical demands of the game. Examples of suitable materials include but are not limited to: high-density plastics, rubberized compounds, thermoplastic elastomers, or any other materials with similar properties.

The bumper covers offers extensive customization options for displaying team logos or other branding elements. The outer surface of the bumper cover can have a smooth finish to accommodate various printing techniques such as screen printing, heat transfer, or adhesive decals. Additionally, the bumper cover may be available in different colors to match team uniforms or fan preferences.

The logo display area is then inserted into the logo display area of the bumper cover. To replace the logo display area, the old logo display area is first removed from the bumper cover. The new logo display area is then inserted into the logo display area of the bumper cover. The bumper cover can be easily branded with team logos or other identifying marks, making it an excellent promotional item for sports organizations and sponsors.

The bumper cover acting as a logo covers for sports helmets provides an innovative solution for both protecting the helmet and displaying team logos. With its customizable options, secure attachment mechanism, and durable materials, the bumper cover offers a reliable and long-lasting branding solution for football teams and fans alike.

Thus, various modifications of these disclosed embodiments are apparent to those skilled in the art, from the description and the accompanying drawing. The principle associated with the various embodiments described herein may be applied to the other embodiments. Therefore, the description is not intended to be limited to the embodiments shown along with the accompanying drawings but is to be providing the broadest scope of consistency with the principles and the novel and inventive features disclosed or suggested herein. Accordingly, the invention is anticipated to hold on to other alternatives, modifications, and variations that fall within the scope of the present invention and appended claims.

The invention claimed is:

1. A sports helmet, comprising:

an outer shell with an ear region, a jaw region, and a faceguard; wherein:

the outer shell comprises a crown, a front region, a rear region, and at least two side regions, the outer shell comprises a front bumper and a rear bumper in the front and rear regions respectively, wherein the front bumper is spaced from the outer shell defining a front gap therebetween, and the rear bumper is spaced from the outer shell defining a rear gap therebetween;

a front bumper cover configured to removably attach to the front bumper, the front bumper cover including at least one front projection tab dimensioned to slidably engage the front gap between the front bumper and the outer shell to lock the front bumper cover in place;

a rear bumper cover having an upper region and a lower region, the upper region having a curved edge comprising an inverted U-shaped projection extending along the curved edge and the lower region having at least one rear projection tab, wherein the inverted U-shaped projection is dimensioned to engage the rear gap between the rear bumper and the outer shell while the at least one rear projection tab is configured to lock a lower end of the rear bumper with the rear bumper cover such that the rear bumper cover is configured to removably attach to the rear bumper; and wherein the front and rear bumper covers are constructed from impact-resistant materials.

2. The sports helmet of claim 1, wherein the bumper covers are manufactured from at least one of: 3d printing and molding.

3. The sports helmet of claim 1, wherein the front and rear bumper covers are configured for attachment of logos/decals of various sport teams.

* * * * *